United States Patent [19]

Brassell

[11] Patent Number: 5,054,402

[45] Date of Patent: Oct. 8, 1991

[54] REMOVABLE COVER FOR GONDOLA CARS WITH LIGHTWEIGHT COMPOSITE PANEL CONSTRUCTION

[76] Inventor: Gilbert W. Brassell, 13237 W. Eighth Ave., Golden, Colo. 80401

[21] Appl. No.: 461,875

[22] Filed: Jan. 8, 1990

[51] Int. Cl.[5] ..... B61D 39/00

[52] U.S. Cl. ..... 105/377; 296/100

[58] Field of Search ..... 105/377, 404, 406.1; 52/17, 309.9, 309.11; 296/100

[56] References Cited

U.S. PATENT DOCUMENTS

| | | | |
|---|---|---|---|
| 1,322,310 | 11/1919 | Kring | 105/377 |
| 2,132,328 | 10/1938 | Tatum | 105/377 |
| 2,202,015 | 5/1940 | Marinello | 105/377 |
| 2,248,500 | 7/1941 | Hilbish et al. | 105/377 |
| 2,889,171 | 6/1959 | Morris | 105/377 |
| 2,977,900 | 4/1961 | Farrar | 105/377 |
| 2,985,118 | 5/1961 | Maharick et al. | 105/377 |
| 3,175,940 | 3/1965 | Talmey | 52/309.9 |
| 3,331,173 | 7/1967 | Elsner | 52/309.11 |
| 3,540,171 | 11/1970 | Kumnick et al. | 105/377 |
| 3,572,821 | 3/1971 | Van Antwerp | 296/100 |
| 3,936,077 | 2/1976 | Bliek | 296/100 X |
| 4,823,707 | 4/1989 | Salsbury et al. | 105/377 |

*Primary Examiner*—Robert J. Oberleitner
*Assistant Examiner*—S. Joseph Morano
*Attorney, Agent, or Firm*—Millen, White & Zelano

[57] ABSTRACT

A lid for gondola cars or the like comprises a rectangular frame approximating in geometry and size the open top of a gondola car and supporting therein a plurality of lightweight panels. In accordance with a preferred embodiment, the lightweight panels are made of a polymer foam sandwiched between sheets of light gauge steel. The lid is retained on the gondola car by a plurality of spaced ratchet binders and includes a pair of spaced tripod straps attached thereto, wherein the lid may be conveniently lifted from and replaced on existing gondola cars. The lid has a weight of approximately twelve hundred pounds.

11 Claims, 2 Drawing Sheets

REMOVABLE COVER FOR GONDOLA CARS WITH LIGHTWEIGHT COMPOSITE PANEL CONSTRUCTION

BACKGROUND OF THE INVENTION

The instant invention relates to covers for gondola cars which are open top railroad cars frequently used to transport bulk materials. More particularly, the instant invention relates to removable covers for gondola cars.

Nuclear and hazardous chemical wastes are usually shipped by truck to dump sites in containers approved by the Department of Transportation. However, the volume of such wastes has become so large that railroads are now being employed for its disposal.

During the past several years, the identification of hazardous nuclear and chemical waste sites has resulted in enormous quantities of dangerous waste which is most economically disposed of by transporting the waste from contaminated sites to isolated dumping sites. Of particular concern is soil contaminated by uranium mill tailings which is a low level radioactive material having a very large volume. The contaminated soil must be retained in gondola cars until the soil arrives at its dump. Since air currents blow over the gondolas while transporting the soil, there is the danger of the area adjacent the railroad tracks becoming contaminated by airborne radioactive particles. Since a large percentage of the particles tend to settle, repeated passage of trains transporting radioactive soil will cause over time a dangerous accumulation of radioactive material adjacent the tracks. Accordingly, it is necessary to cover gondola cars.

In accordance with present practice, gondolas are covered with a disposable plastic cover which is removed when the gondola arrives at the dump site and disposed of with the hazardous contents of the gondola. Both the inside and outside of the gondola must then be decontaminated prior to being released for a return trip or further service. The cost of disposable covers and cost of decontaminating gondolas is considerable. Accordingly, there is a need for another approach for covering gondola cars.

As is evident from the prior art, there are a number of covers which may be attached to or retrofitted to gondola cars such as the covers exemplified in U.S. Pat. Nos. 2,985,118; 3,106,900; 3,631,816; and 2,674,280. These covers are, however, quite expensive, heavy and difficult to retrofit. Since operations such as removing soil from sites contaminated by uranium mill tailings require enormous numbers of gondola cars, the expense of utilizing only covered cars or retrofitting cars available from existing rolling stock can be prohibitive. There are, of course, lightweight fabric covers as exemplified by U.S. Pat. Nos. 4,823,708 and 3,044,653. However, these covers, according to regulations and for safety purposes, must be disposed of at the site in the same manner as currently used plastic covers.

In view of these considerations and other considerations, there is a need for a gondola cover which is relatively inexpensive, lightweight, reusable and readily retrofittable to existing rolling stock. The cover is of special interest for shipping low level radioactive waste such as soil contaminated by uranium mill tailings.

SUMMARY OF THE INVENTION

It is an object of the instant invention to provide a new and improved lightweight cover for open top transportation vehicles, such as gondola cars and open topped trucks, which cover is of special significance with respect to gondola cars used to transport hazardous waste such as soil contaminated by uranium mill tailings.

Upon further study of the specification and appended claims, further objects and advantages of this invention will become apparent to those skilled in the art.

In view of the aforementioned objects and other objects, the instant invention contemplates a lid for covering a gondola car, or the like, wherein the lid is comprised of a plurality of polymeric foam panels, each of which is clad with light gauge metal. The panels are mounted in a relatively rigid, rectangular metal frame having a plurality of tie-down devices disposed around its periphery. At least one, and preferably two, tripod straps are provided for lifting the cover from the gondola car by relatively light duty hoists at both the loading site and disposal site.

In a preferred configuration, the lid is comprised of a plurality of sections with each section including a plurality of metal clad foam panels therein.

Further with respect to the preferred embodiment, the frame is comprised of a grid having a plurality of steel L-shaped struts around the periphery of the frame and a series of inverted T-bars extending laterally from one side of the frame to the other. The peripheral L-shaped frame members are attached to one another by flat steel bars bolted thereto.

In the preferred embodiment, the panels consist of either polyurethane or polystyrene foam panels clad with light gauge steel. In accordance with additional embodiments of the invention, the frame may be made of aluminum tubing or polypropylene tubing and the panels comprised of aluminum honeycomb sandwiched between aluminum sheets or simply polypropylene sheets.

Utilization of the aforedescribed lid saves the user considerable expense over costs in only a few months and eliminates environmental problems associated with disposal of contaminated covers made of polymeric materials which do not readily decompose.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
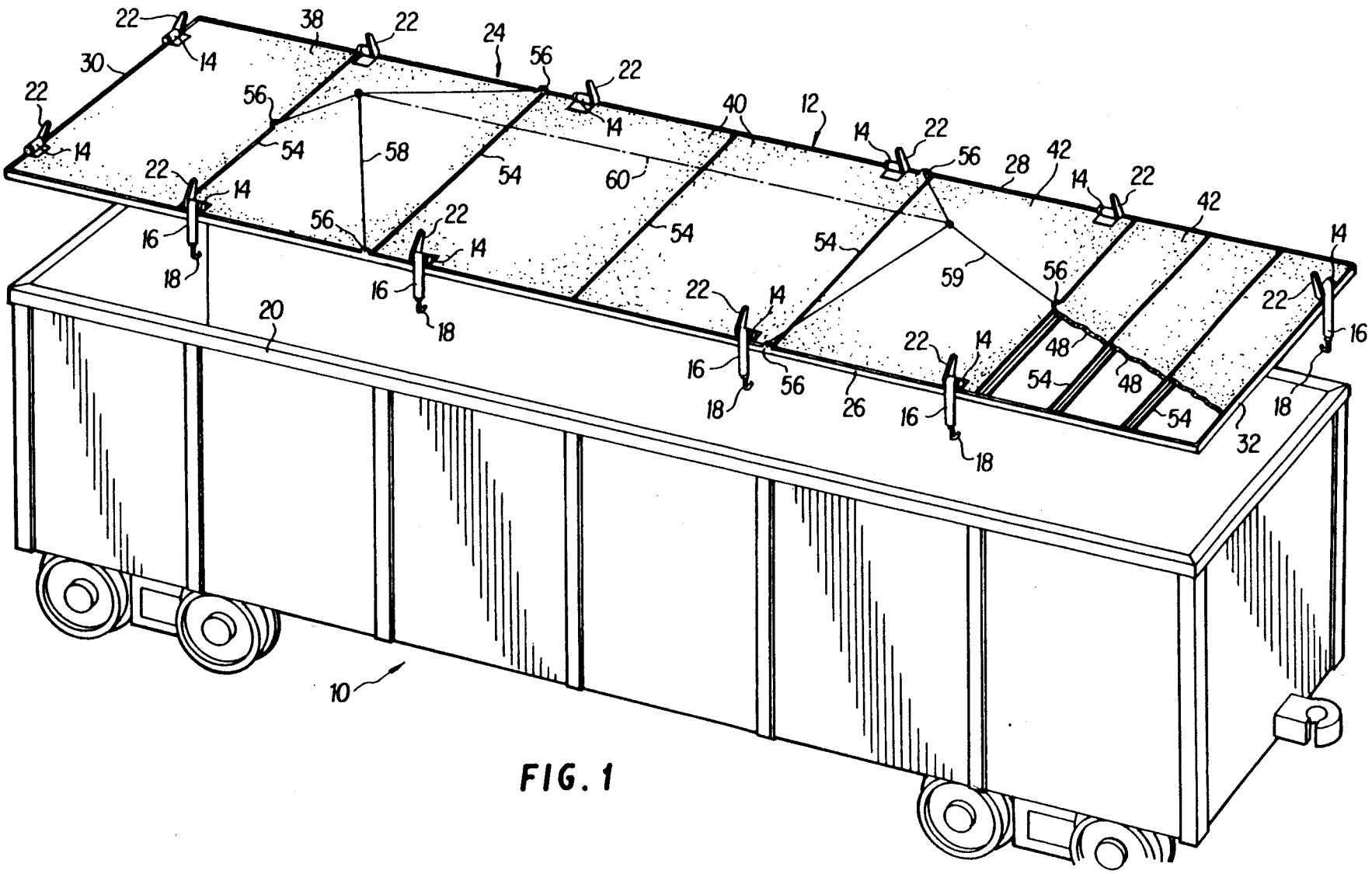
FIG. 1 is a perspective view of a gondola car with a cover configured in accordance with the principles of the instant invention.

Referring now to FIG. 1, there is shown a gondola car designated generally by the numeral 10, to which is attached a lid or cover, designated generally by the numeral 12, and configured in accordance with the principles of the instant invention. The lid 12 has a plurality of conventional ratchet binders 14, each having a strap or cable 16 wrapped therearound which has a hook 18 for engaging around the lower surface of a rail, flange or the like 20 on the gondola car 10. The ratchet binders 14 are tightened by handles 22 to tighten the straps 18. In the illustrated embodiment, there are 12 ratchet binders 14 distributed in spaced relation around the periphery of the lid 12 so as to readily attach the lid to the gondola car 10. The gondola car 10 is selected from existing rolling stock preferably having a width of 10 feet and length of 52 feet. In that there are thousands of gondola cars of this size, lid 12 is readily retrofitted to much of the available rolling stock.

One use for gondola cars such as the gondola car 10 is hauling low level radioactive contaminated soils such as uranium mill tailings to dump sites. In order to avoid contaminating the air, ground and water adjacent tracks over which the gondola cars 10 travel, it is necessary to cover the gondola cars. Gondola cars available from the inventory of rolling stock do not have lids so there is a need for retrofittable or readily attachable lids for this purpose. The current approach is to use disposable plastic covers. However, at the end of each run, the covers must be left at the dump site and the cars washed out and thoroughly cleaned so that they do not contaminate the environment adjacent the track on the way back to the mine. This is, of course, expensive and time-consuming. The problem is readily solved by the lids 12 of the instant invention, which are replaced prior to the return trip negating the necessity for washing out the insides of gondola cars.

Figure 2:
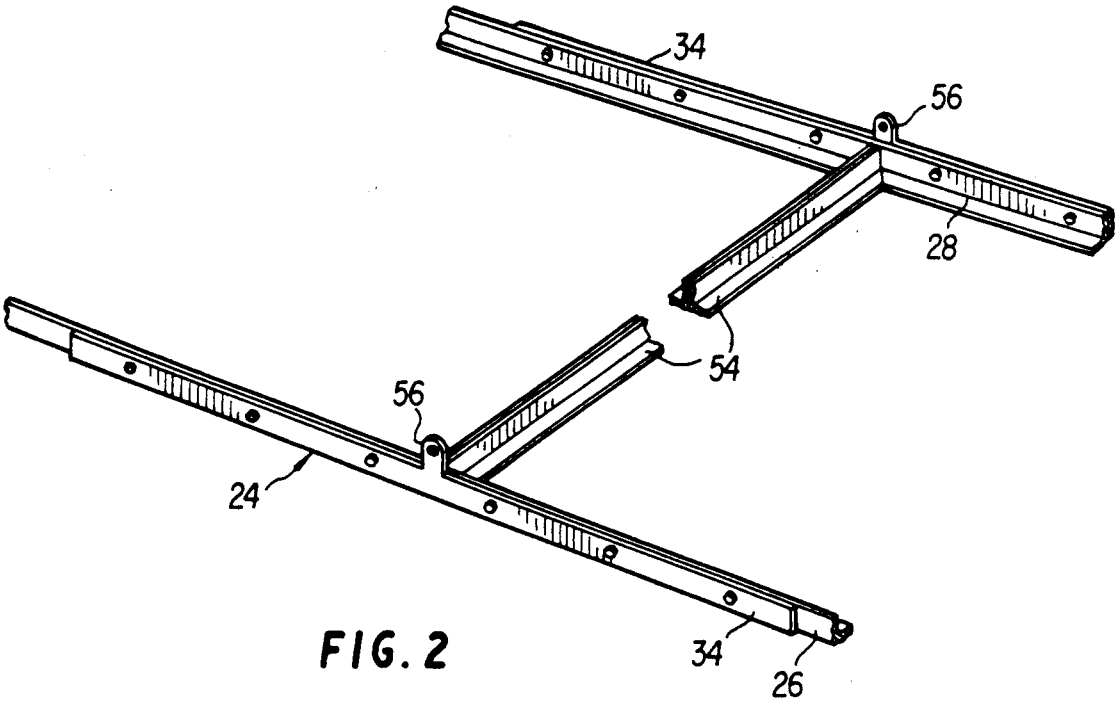
FIG. 2 is a perspective view of a section of a cover frame shown in FIG. 1.
Figure 3:
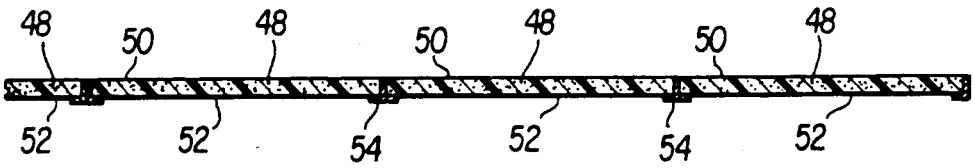
FIG. 3 is a cross-section taken along lines 3—3 of FIG. 2, showing chain members in cross section.

Referring now more specifically to the structure of the lid 12, it is seen that the lid 12 has a frame, designated generally by the numeral 24, comprised of a pair of longitudinal strut members 26 and 28, joined by a pair of lateral end strut members 30 and 32 defining a frame structure having a rectangular configuration. In accordance with a preferred embodiment of the invention, the strut members 26, 28, 30 and 32 are three-quarter inch steel angle struts with a thickness of about one-eight of an inch. As is seen in FIG. 2, the steel angles forming the longitudinal strut members 26 and 28 are joined by one inch by three-sixteenths inch flat steel bars 34 which are bolted thereto at approximately one foot intervals so as to form continuous longitudinal struts. The end struts 30 and 32 may be either welded or bolted to the longitudinal struts 26 and 28.

Lid 12 is made up of subsections designated generally by the numerals 38, 40 and 42 with the subsections 40 and 42 having a length of eighteen feet and the subsection 38 having a length of sixteen feet. The subsections themselves are joined by the lengths of one by three-sixteenths flat steel bars 34 bolted to the outside of the L-shaped members 26 and 28.

Each of the subsections 38, 40 and 42 is comprised of a plurality of panels made of a polyurethane or polystyrene foam core 48 sandwiched between a pair of light gauge (approximately 28 gauge), upper and lower metal skins 50 and 52, respectively. End panels 48 are supported along one long edge by the end angles 30 and 32 with the short ends supported by the longitudinal angles 26 and 28. Extending across the frame are three-quarter inch by one and one-half inch T-bars 50 which support each of the panels 48 adjacent the long edges while their short edges rest on the longitudinal angles 26 and 28. The individual panels 48 are approximately three feet wide, ten feet three inches long and one and one-half inches thick.

While in the preferred embodiment, polyurethane or polystyrene foam 48 sandwiched between layers 50 and 52 of light gauge steel supported by a steel frame 24 is a preferred embodiment due to its lightweight as well as its low cost. Another embodiment of the invention might utilize an aluminum frame with aluminum honeycomb panels sandwiched between aluminum sheets. A third embodiment utilizes polypropylene tubing for the supporting frame and polypropylene sheets for covering panels.

In the illustrated embodiment, the eighteen foot subsections 40 and 42 are each divided into two nine foot portions, each of which portions has three of the panels 48. Subsection 38 has a nine foot portion and a seven foot portion, with the seven foot portion having one three foot wide panel and one four foot wide panel. The resulting lid 12 configured as the preferred embodiment has a weight of approximately one thousand two hundred pounds so that it can be lifted by inexpensive, readily available mobile hoists. This is accomplished by bolting or welding a plurality of eyes 56 to the frame 24 so as to support a pair of tripod straps 58 and 59. The tripod straps 58 and 59 are connected by central lifting line 60 which has an eye 62 thereon for being hooked by a hoist (not shown).

Over the course of a few months, panels save the user considerable time and money. The panels can be secured and released by relatively unskilled workers and may be handled by conventional hoist equipment with minimal danger. The panels eliminate environmental problems associated with disposal of contaminated polymeric covers which are now used and which do not readily decompose. Lids 12 have a sufficient rigidity and strength to withstand sustained winds generated by train speeds of at least 60 miles an hour so as to remain in place to cover contaminated cars on return trips from dumps to uranium mines. Since the interior of the gondola cars 10 need not be cleaned until the cars are taken out of service, the problem of what to do with water contaminated from washing the cars is minimized and the task of cleaning up sites such as those containing uranium mill tailings is greatly eased.

The entire texts of all applications, patents and publications, if any, cited above and below, and of corresponding application(s), are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A lid for covering the open top of a gondola car, the lid comprising:

a rectangular frame defining a periphery of the lid, the frame having a geometry similar to and size slightly larger than the open top of the gondola car and including an array of metal struts arranged in a grid to define a plurality of spaces of a selected geometry;

fastening means for detachably securing the lid to the gondola car, the fastening means being distributed in spaced relation around the periphery of the lid;

a plurality of lightweight panels, each panel having a geometry similar to that of a space defined in the grid and being received and supported within the corresponding space of the grid to cover the open top of the gondola car when the frame is placed thereon;

said lightweight panels comprising metal skins with lightweight material sandwiched therebetween; and means for lifting the lid from and onto the gondola car when the fastening means are disengaged.

2. The lid of claim 1, wherein the lightweight material is comprised of polymer foam material.

3. The lid of claim 2, wherein the weight of the lid does not exceed one thousand two hundred pounds.

4. The lid of claim 3, wherein the lifting means comprises a pair of tripod straps fastened to the frame and positioned in spaced relation to one another inboard of the longitudinal ends of the lid.

5. The lid of claim 1, wherein the attaching means are individual ratchet binders having cable means extended therefrom with hooks for securing to the sides of the gondola car at locations beneath the top of the gondola car.

6. The lid of claim 5, wherein the grid is rectangular.

7. The lid of claim 1, wherein the grid is rectangular.

8. The lid of claim 7, wherein the grid comprises a pair of longitudinally extending strut members made of L-shaped steel struts, the longitudinal members being joined at their ends with L-shaped steel struts to form the periphery of the frame and the frame further including a plurality of T-shaped lateral struts extending between the longitudinal struts in perpendicular relation thereto, to T-shaped struts and L-shaped struts cooperating provide surfaces for supporting panels adjacent the edges of the panels wherein the panels are supported within the grid.

9. The lid of claim 8, wherein the panels are comprised of a polymer foam material sandwiched between sheet metal skins.

10. The lid of claim 9, wherein polymer foam material is selected from the group consisting of polyurethane and polystyrene and the sheet metal skins are made of approximately 28 gauge steel sheet.

11. The lid of claim 1, wherein the gondola car is specifically used to shuttle radioactive waste from a contaminated site to a dump site, the lid having a flat top surface and a flat bottom surface.

* * * * *